US005662527A

United States Patent [19]

Jacquinot et al.

[11] Patent Number: 5,662,527

[45] Date of Patent: Sep. 2, 1997

[54] GOLF PRACTICE DEVICE

[76] Inventors: Chuck Robert Jacquinot, 1824 Overlook Dr., Fort Collins, Colo. 80526; John Phillip Jacquinot, 15497 Rockbluff Rd., Ottumwa, Iowa 52501

[21] Appl. No.: 643,335

[22] Filed: May 6, 1996

[51] Int. Cl.[6] ..... A63B 69/36

[52] U.S. Cl. ..... 473/138; 473/575

[58] Field of Search ..... 473/138, 147, 473/238, 575

[56] References Cited

U.S. PATENT DOCUMENTS

| | | | |
|---|---|---|---|
| 1,326,976 | 1/1920 | Schnurr | 473/147 |
| 3,065,563 | 11/1962 | Bascom | 473/138 X |
| 3,262,705 | 7/1966 | Nunziato | 473/238 |
| 4,014,552 | 3/1977 | Watson | 273/185 C |
| 4,014,553 | 3/1977 | Sakamoto | 273/200 R |
| 4,660,835 | 4/1987 | Locurto | 273/200 R |
| 5,054,786 | 10/1991 | Soloman | 273/200 R |
| 5,386,997 | 2/1995 | Smith | 273/198 |
| 5,413,347 | 5/1995 | Prater | 273/200 A |

*Primary Examiner*—George J. Marlo

*Attorney, Agent, or Firm*—John D. Gugliotta; David L. Volk

[57] ABSTRACT

A golf club includes an elongated shaft, a head, and a handle. A retrieval reel is affixable along the shaft of the golf club. A retrieval line is stored within the retrieval reel. A guide eye is affixable along the shaft of the golf club. A golf practice ball includes a receiving hole. A screw is configured to threadedly engage within the receiving hole. The screw includes a threaded shaft and a head, the head comprising a substantially planar surface oriented substantially perpendicular to the threaded shaft. A hole penetrates through the surface of the head. The hole is configured to create a communicating path from outside of the golf practice ball to inside the receiving hole when the screw is engaged within the receiving hole.

2 Claims, 3 Drawing Sheets

GOLF PRACTICE DEVICE

RELATED APPLICATIONS AND DISCLOSURE DOCUMENTS

This application is a continuation of the invention described in the Disclosure Document No. 382,685, dated Oct. 2, 1995.

BACKGROUND OF THE INVENTION

1. Field of the Invention

The present invention relates generally to golf clubs and, more particularly, to a golf practice club affixed to a retrievable golf ball.

2. Description of the Related Art

In the related art, many devices and methods for practicing the game of golf are known. For example, in U.S. Pat. No. 5,413,347, issued in the name of Prater, devices for hitting golf balls when in confined spaces are disclosed. Also, in U.S. Pat. No. 5,386,997, issued in the name of Smith, a portable golf practice apparatus is disclosed. And, in U.S. Pat. No. 5,054,786, issued in the name of Solomon, a tethered golf ball is disclosed. And again, in U.S. Pat. No. 4,660,835, issued in the name of Locurto, a tethered ball golf practice device is disclosed. And finally, in U.S. Pat. No. 4,014,553, issued in the name of Sakamoto, a combined golf ball tether and anchor structure is disclosed.

Although these and other devices can be used to aid a user in training and practice of the game of golf, such devices are associated with several drawbacks. For example, few can be utilized with regular golf balls and as an attachment to regular golf clubs. Moreover, none provide for easy ball retrieval. And, very few are adaptable enough to be used either indoors or outdoors.

Consequently, a need has been felt for providing an apparatus and method for aiding a user in practicing golf strokes in a repetitive manner while being attachable to regular golf clubs.

SUMMARY OF THE INVENTION

It is therefore an object of the present invention to provide an improved golf practice club and ball combination.

It is therefore another object of the present invention to provide an accessory for traditional golf clubs that allow golfers to automatically retrieve their ball after a practice putt or chip without.

It is a feature of the present invention to provide a practice accessory which can be attached any standard golf club, and later removed from the club for regular play.

Briefly described according to the preferred embodiment of the present invention, a golf practice club and ball combination is provided as an attachment to putters and other golf clubs. Aiding golfers attempting to improve and practice their putting and driving, this accessory consists of a fishing reel and eye affixed to the section under the grip and on the shaft above the putter or club head, respectively. A fishing line extends down the length of the club and attaches to the ball. After putting, chipping or driving, the ball may be retrieved simply by "reeling" it in with the fishing reel.

An advantage of the present invention is that it provides efficient and effortless retrieval of a golf ball after practice shots.

Another advantage of the present invention is that the golfer has the ability to remain at the same putting or driving point while reeling in the ball, allowing him/her to practice a troublesome shot over again.

Further, a preferred embodiment of the present invention has may also be used either indoors or outdoors, and can be removed from the club for play.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
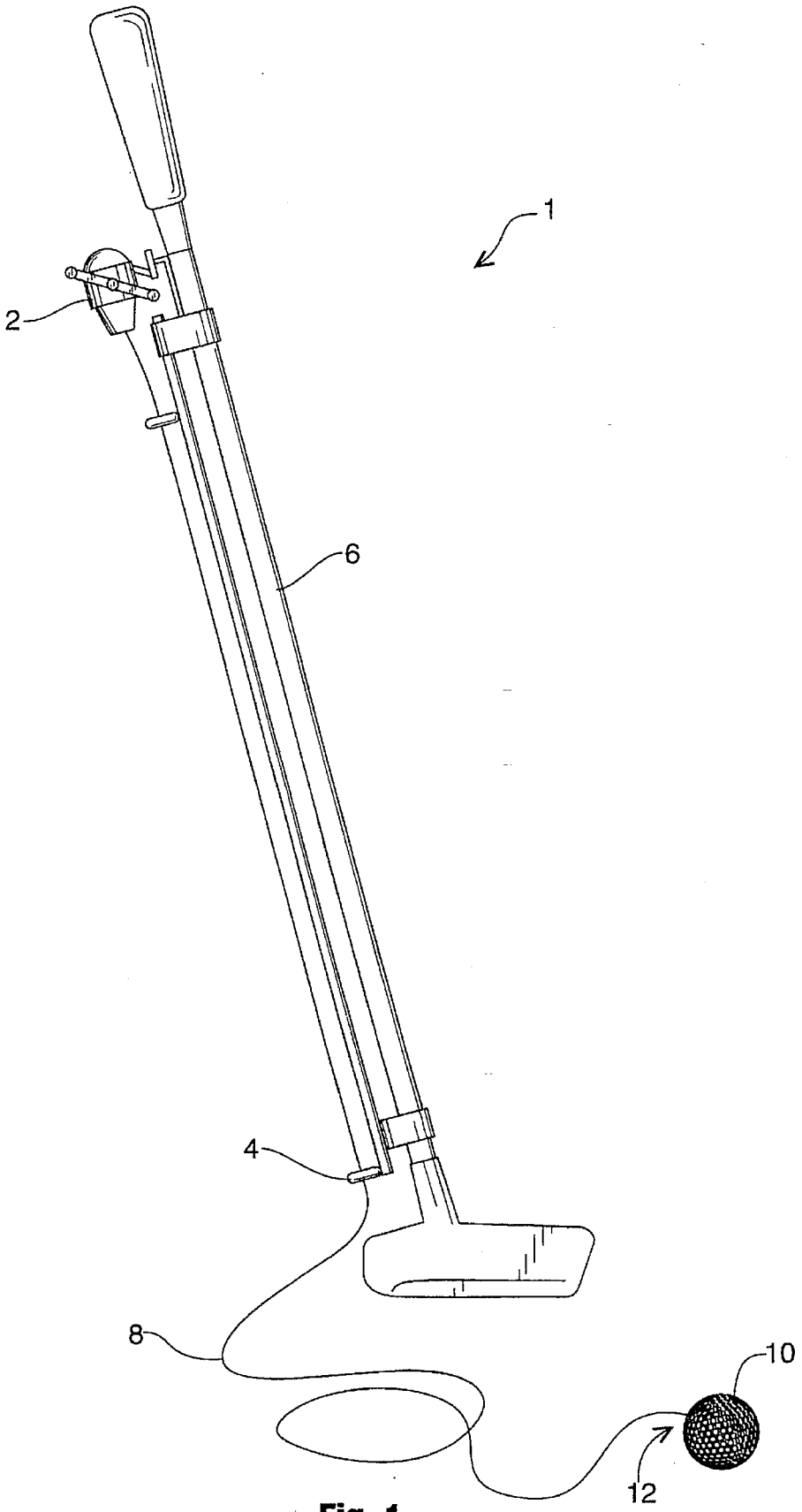
FIG. 1 is a perspective view of a golf practice club and ball combination according to the preferred embodiment of the present invention.

Referring now to FIG. 1, a golf practice club and ball combination 1 is shown, according to the present invention, having a retrieval reel 2 and a guide eye 4 affixed along the shaft of a standard golf club 6. The retrieval reel 2 discharges and retrieves a retrieval line 8, which is then guided through the guide eye 4 and affixed to a golf practice ball 10 by a line ball connection means 12. Although it is envisioned that many configurations will suffice, It is presently envisioned that in the preferred embodiment of the present invention the retrieval reel 2 consists of a standard, generally available fishing reel of the type utilized with a fishing rod. As such, it is envisioned that the retrieval line 8 consists of a standard nylon fishing line.

Figure 2:
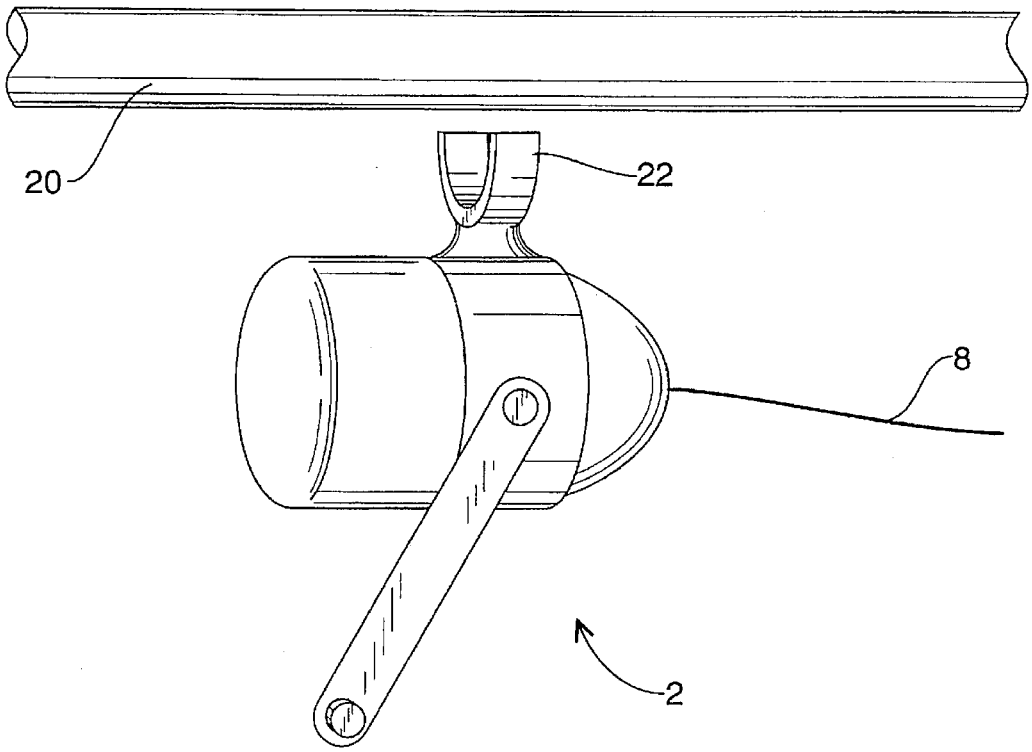
FIG. 2 is a detailed side elevational view of a retrieval reel affixed to a golf practice club.

Referring to FIG. 2, the retrieval reel 2 is shown mounted to the underside of the upper portion of the shaft 20 of a conventional golf club 6. It is anticipated that the retrieval reel 2 would be best located at or near the handle portion of the shaft 20, within easy access of the club grip (not shown). Other locations are also possible, however. It is envisioned that a first club attachment means 22 affixed to the upper portion of the retrieval reel 2 provides a means of removably attaching, detaching, and reconnecting the retrieval reel 2 to the shaft 20. In its preferred embodiment, the first club attachment means 22 consists of a "C" shaped snap clamp. It is also envisioned that other methods, such as tape type adhesives, hook and loop fastener straps, or other conventional attachment means such as screws could also be utilized to sufficiently affix the retrieval reel 2 to the shaft 20.

Figure 3:
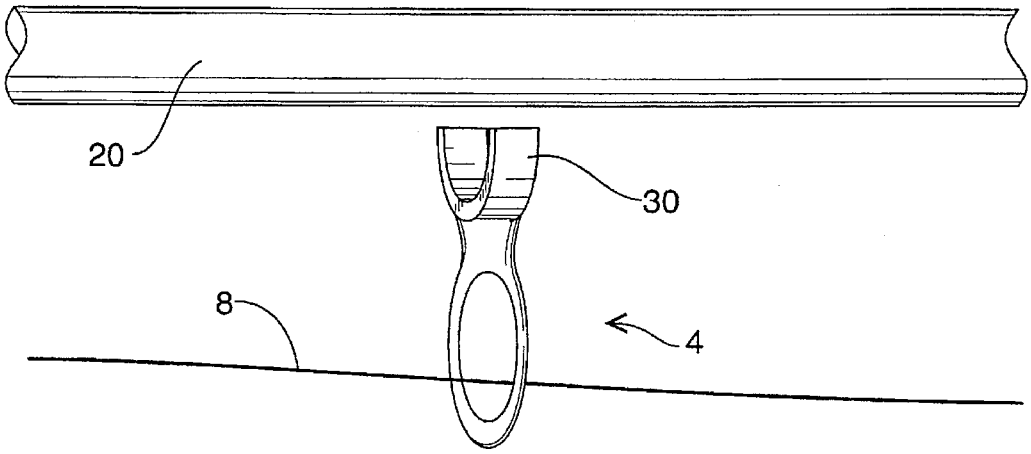
FIG. 3 is a detailed side elevational view of a guide eye affixed to a golf practice club.

FIG. 3 shows the guide eye 4 mounted to the underside of the lower portion of the shaft 20 of a conventional golf club 6. It is anticipated that the guide eye 4 would be best located at or near the head portion of the shaft 20. Other locations are also possible, however. It is envisioned that a second club attachment means 30 affixed to the upper portion of the guide eye 4 provides a means of removably attaching, detaching, and reconnecting the guide eye 4 to the shaft 20. In its preferred embodiment, the second club attachment means 30 is similar in action and structure to the first club attachment means 22, and could consist of a "C" shaped snap clamp. It is also envisioned that other methods, such as tape type adhesives, hook and loop fastener straps, or other conventional attachment means such as screws could also be utilized to sufficiently affix the guide eye 4 to the shaft 20.

Figure 4:
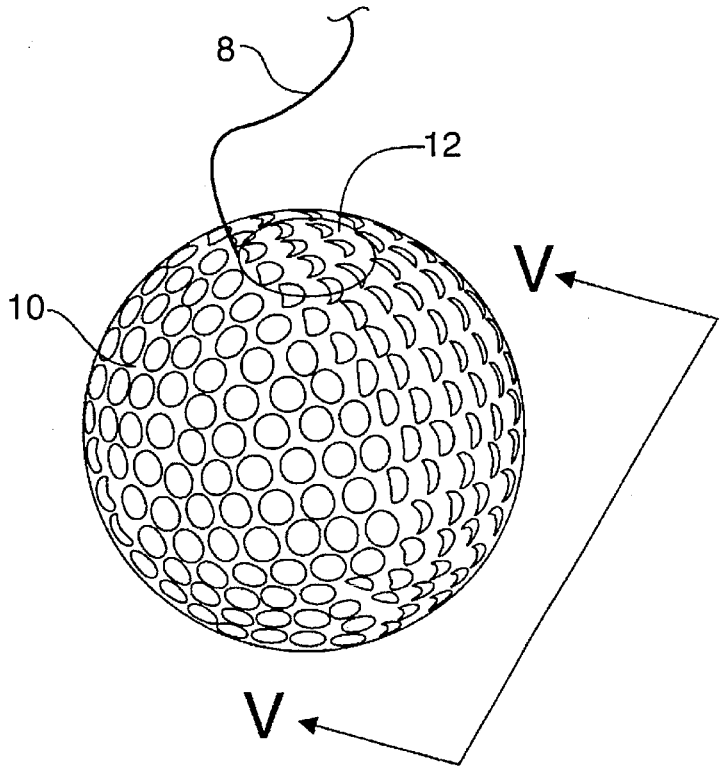
FIG. 4 is a detailed plan view of a golf practice ball for use therewith.
Figure 5:
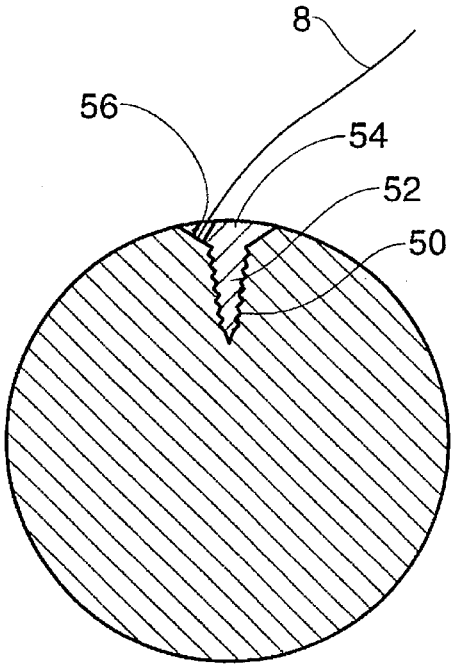
FIG. 5 is a cross sectional view of a golf practice ball taken along line V—V of FIG. 4.

As shown in FIG. 4 and FIG. 5, the attachment of the retrieval line 8 to the golf practice ball 10 via the line ball connection means 12 is shown in greater detail. The related art is replete with numerous examples of tethering or otherwise affixing a ball to a line. These examples could easily be effectively incorporated in combination with the teachings of the present invention. However, it has been found that by affixing a retrieval line 8 formed of a standard fishing line to a modified, conventional golf ball 10, the function of the present invention can emulate the actual flight and roll of a non-tethered golf ball. To accomplish this, a threaded receiving hole 50 is formed within the golf ball 10. A flat-head screw 52 is then engaged within the receiving hole 50. By wrapping the end of the retrieval line 8 around the screw 52 prior to complete engagement, the retrieval line 8 can be impinged between the inner surface of the hole 50 and the bottom surface of the screw head 54. By engaging the screw 52 to a point where the upper surface of the screw head 54 remains below the plane formed by the outside circumference of the golf ball 10. Alternately, an even firmer connection between retrieval line 8 and golf practice ball 10 can be achieved if a small receiving hole 56 is bored through either the screw head 54 (as shown) or the screw shaft (not shown) in order to threadingly receive the retrieval line 8 prior to tightening of the screw 52 into the hole 50.

2. Operation of the Preferred Embodiment

To use the present invention, a user merely need to attach the retrieval reel 2 and guide eye 4 to a putter, sand wedge, or any other conventional golf club. The retrieval line 8 is then discharged from the reel 2 and threaded through the guide eye 4, prior to attachment to the golf practice ball in a manner as described above.

The user is now ready to practice putting indoors, or practice putting, chipping, or even driving outdoors. When the golf practice ball 10 comes to a rest after a shot, the user is now able to merely maintain their position and "reel in" the ball.

The foregoing description is included to illustrate the operation of the preferred embodiment and is not meant to limit the scope of the invention. Many minor improvements are envisioned with respect to the individual elements as taught within the present specification. For example, it is envisioned that incremental improvements in the method of affixing the line the golf ball can be gleaned from the art as well as within future improvements. Therefore, the scope of the invention is to be limited only by the following claims.

What is claimed is:

1. A golf practice club and ball combination comprising:

a. a golf club having an elongated shaft, a head, and a handle;

b. a retrieval reel affixable along said shaft;

c. a retrieval line stored within said retrieval reel;

d. said retrieval reel configured to discharge and retrieve said retrieval line;

e. a guide eye affixable along said shaft;

f. a golf practice ball;

g. a receiving hole formed within said golf practice ball;

h. a screw configured to threadedly engage within said receiving hole;

i. said screw having a threaded shaft and a head, the head comprising a substantially planar surface oriented substantially perpendicular to said threaded shaft, a hole penetrating through said surface, said hole configured to create a communicating path from outside of said golf practice ball to inside said receiving hole when said screw is engaged within said receiving hole;

j. wherein to prepare said combination for use, said retrieval reel is affixed to said shaft near said handle, said guide eye is affixed to said shaft between said retrieval reel and said head, said retrieval line is guided through said guide eye and threaded through said hole penetrating through said head, and said screw is threadedly engaged in said receiving hole, thereby wrapping said retrieval line around said threaded shaft and securely engaging said retrieval line within said golf practice ball.

2. A golf practice apparatus for use with a conventional golf club having a head, a handle, and a shaft, said apparatus comprising:

a. a retrieval reel adapted to attach to the shaft of the golf club;

c. a retrieval line stored within said retrieval reel;

d. said retrieval reel configured to discharge and retrieve said retrieval line;

e. a guide eye adapted to attach to the shaft of the golf club;

f. a golf practice ball;

g. a receiving hole formed within said golf practice ball;

h. a screw configured to threadedly engage within said receiving hole;

i. said screw having a threaded shaft and a head, the head comprising a substantially planar surface oriented substantially perpendicular to said threaded shaft, a hole penetrating through said surface, said hole configured to create a communicating path from outside of said golf practice ball to inside said receiving hole when said screw is engaged within said receiving hole;

j. wherein to prepare said apparatus for use, said retrieval reel is affixed to the shaft of the golf club near the handle, said guide eye is affixed to the shaft of the golf club between said retrieval reel and the head, said retrieval line is guided through said guide eye and threaded through said hole penetrating through said head, and said screw is threadedly engaged in said receiving hole, thereby wrapping said retrieval line around said threaded shaft and securely engaging said retrieval line within said golf practice ball.

* * * * *